US005334128A

United States Patent [19]

Carrico et al.

[11] Patent Number: 5,334,128

[45] Date of Patent: Aug. 2, 1994

[54] APPARATUS AND METHOD FOR FOLDING OVER AN EDGE PORTION OF THIN SHEET

[75] Inventors: Philip H. Carrico, Greenfield Center; Roger W. Holmes, Queensbury, both of N.Y.

[73] Assignee: General Electric Company, Fort Edward, N.Y.

[21] Appl. No.: 944,103

[22] Filed: Sep. 11, 1992

[51] Int. Cl.[5] ..... B65H 45/08; B65H 45/22

[52] U.S. Cl. ..... 493/439

[58] Field of Search ..... 493/418, 439

[56] References Cited

U.S. PATENT DOCUMENTS

| | | | |
|---|---|---|---|
| 1,501,499 | 7/1924 | Swift | 493/440 |
| 2,540,844 | 2/1951 | Strauss | 493/439 |
| 3,111,310 | 11/1963 | Dutro et al. | 493/439 |
| 3,544,107 | 12/1970 | Blomberg | 493/439 |
| 3,799,536 | 3/1974 | Gregoire | 493/436 |
| 4,420,148 | 12/1983 | Meadows | 493/439 |
| 4,421,501 | 12/1983 | Scheffer | 493/439 |
| 4,591,354 | 5/1986 | Gelbard | 493/439 |
| 5,152,738 | 10/1992 | Zehender | 493/440 |

OTHER PUBLICATIONS

Information sheet on "Air Bars" from Newmet Krebsoge, Rte. 6 & Burr Rd, Terryville, Conn. 06786, dated 1991 or earlier (exact date unknown).

Article by W. R. Johnson et al entitled "Controlling Fluid Flow with Porous Metals", Reprint from *Machine Design,* Jan. 8, 1987, 2 pages.

Sheet from Catalogue DB3100, Mott Metallurgical Corp., Farmington, Conn. 06032, entitled "Air Film Rolls", dated Jun. 1987.

Admitted prior art; First and Second paragraph under, "Background", p. 1 of present patent application Ser. No. 07/944,103.

*Primary Examiner*—William E. Terrell

*Attorney, Agent, or Firm*—Henry J. Policinski; William Freedman

[57] ABSTRACT

This apparatus acts to fold over along a crease line an edge portion of a thin sheet of material, such as aluminum foil. On opposite sides of the crease line, the sheet includes a body portion and an edge portion, which edge portion is in-line with the body portion when the sheet is unfolded and is doubled back on the body portion when the sheet is fully folded.

A pair of support rolls have spaced-apart axes and peripheries over which the sheet is caused to pass so that a region of the sheet extends between the peripheries. During the folding process the sheet is caused to travel in a direction extending from a first to a second one of the support rolls. An air film roll is positioned between the support rolls and exerts on the region of the traveling sheet between the support rolls a force that causes the body portion of the sheet in this region to be deflected toward the zone between the support roll axes.

The air film roll has an outer end located at the crease line so that the edge portion folds along the crease line from the in-line position at the first support roll to a position perpendicular to the body portion at the outer end of the air film roll and then to the doubled-back position at the second support roll.

4 Claims, 4 Drawing Sheets

APPARATUS AND METHOD FOR FOLDING OVER AN EDGE PORTION OF THIN SHEET

TECHNICAL FIELD

This invention relates to an apparatus and a method for folding over an edge portion of a thin sheet of material, e.g., aluminum foil, as the sheet is driven along its length.

BACKGROUND

One prior-art method of affecting such folding of a sheet of foil involves running the sheet over the end of a roll in such a way that an edge portion of the sheet projects beyond the end of the roll. This initiates a fold in the foil at the end of the roll, causing the edge portion of the sheet to partially fold over toward the body portion of the sheet. Thereafter, a finger or roller is forced against the partially-folded edge portion of the foil sheet, thereby forcing the edge portion into a substantially fully-folded position with respect the body portion. The fold is set as the folded portion of the sheet goes over another roller. This technique is not as reliable as often required, does not always leave a clean fold, and has a tendency to pucker the edge of the foil sheet.

Another prior-art method of folding involves use of an appropriately shaped shoe which rubs against the edge portion of the moving foil sheet and forces the edge portion to fold up and over as the foil sheet moves ahead. A disadvantage of this method is that the rubbing relationship of the shoe on the foil sheet produces objectionable drag on the moving sheet and also generates dirt particles.

OBJECTS

An object of our invention is to provide a reliable technique for folding over the edge portion of a thin sheet of material that leaves a clean fold and has a reduced tendency to pucker the edge of the sheet.

Another object is to provide a folding technique that can be practiced with simple apparatus, produces little drag on the moving sheet, and generates few dirt particles.

Another object is to provide simple apparatus for carrying out the above objects.

SUMMARY

In carrying out the invention in one form, we provide apparatus for folding over along a crease line an edge portion of a thin sheet of material, such as aluminum foil. The sheet comprises on opposite sides of the crease line a body portion and an edge portion integral with the body portion and extending between the body portion and the edge of the sheet. The edge portion is substantially in line with the body portion when the sheet is unfolded and is doubled back into an overlapping position on the body portion when the sheet is fully folded.

The apparatus comprises a pair of support rolls having laterally spaced-apart axes and peripheries over which the sheet is caused to pass so that a predetermined region of the sheet extends between said peripheries. During the folding process the sheet is caused to travel in a direction extending from a first to a second one of said support rolls. An air film roll is positioned between said support rolls and exerts on said predetermined region of the traveling sheet a force that causes the body portion of the sheet in said predetermined region to be deflected toward the zone between the support roll axes.

The air film roll has an outer end that is located at said crease line so that said edge portion of the foil sheet folds along said crease line from said in-line position at said first support roll to a position substantially perpendicular to said body portion at said outer end of the air film roll and then folds along said crease line from said perpendicular position to said overlapping position in the zone of the sheet extending between said outer end of the air film roll and said second roll.

BRIEF DESCRIPTION OF FIGURES

For a better understanding of the invention, reference may be had to the following detailed description of an embodiment taken in conjunction with the accompanying drawings, wherein.

DETAILED DESCRIPTION OF EMBODIMENT

Figure 1:
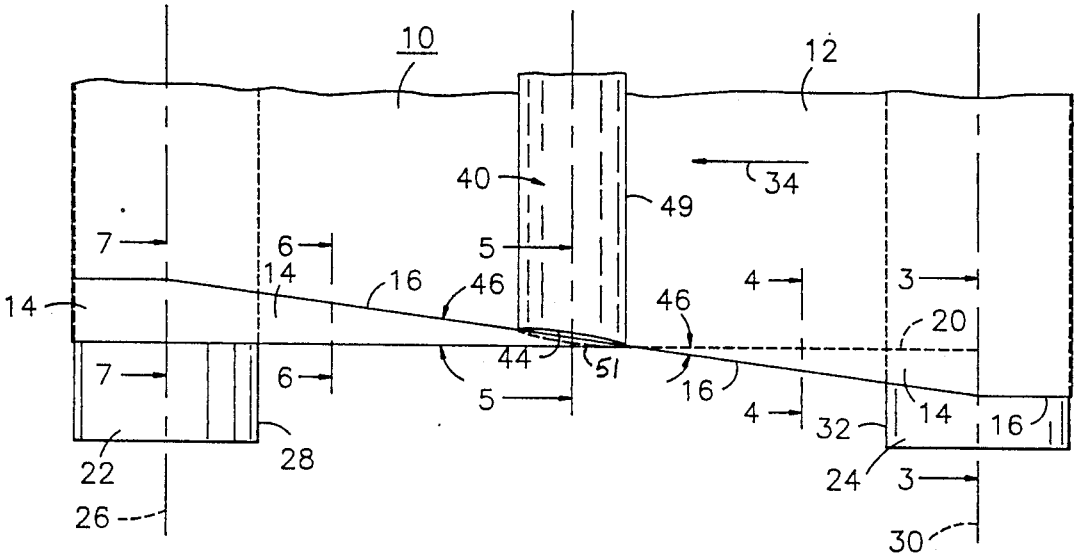
FIG. 1 is a plan view of folding apparatus embodying one form of the invention. The apparatus is in the process of folding over an edge portion of a sheet of foil as the foil sheet travels from right to left.
Figure 3:
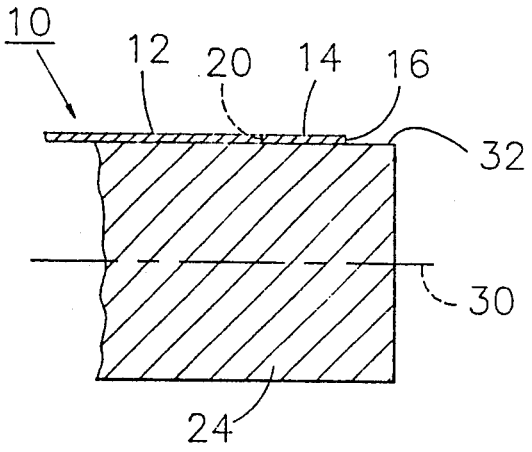
FIG. 3 is a sectional view along the line 3—3 of FIG. 1. The thickness of the foil is exaggerated in FIGS. 3-7.
Figure 7:
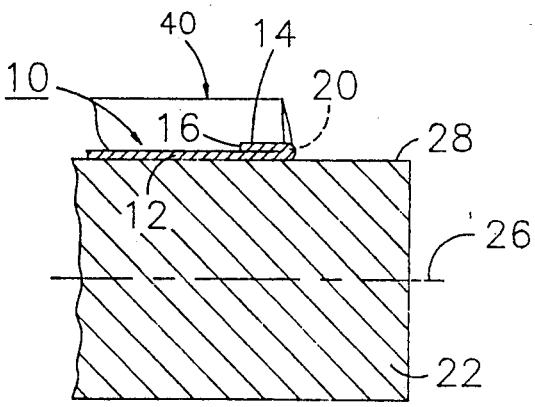
FIG. 7 is a sectional view along the line 7—7 of FIG. 1.

Referring now to the plan view of FIG. 1, there is shown a sheet 10 of creasable material, such as aluminum foil, that comprises a body portion 12 and an edge portion 14. When the sheet 10 is still in its unfolded condition, as depicted in the lower right-hand corner of FIG. 1, the edge portion 14 extends between the body portion 12 and one edge 16 of the sheet 10. In this still-unfolded condition of the sheet, the edge portion 14 is substantially in-line with the body portion 12, as best shown in FIG. 3. When the edge portion 14 has been folded into its fully-folded position, the edge portion is doubled back into an overlapping position with respect to the body position 12, as best shown in FIG. 7. Folding of the edge portion occurs along a crease line 20 that extends parallel to the edge 16 of the sheet when the sheet is unfolded, as in FIG. 3.

For supporting and guiding the sheet 10 during the folding operation, two spaced-apart rolls 22 and 24 are provided. Each of these rolls has a fixed axis about which the roll rotates when the sheet 10 passes over its periphery. The axis of left-hand roll 22 is designated 26 and its periphery 28. The axis of right-hand roll 24 is designated 30 and its periphery 32. During the folding operation, the sheet 10 travels from right to left in FIG.

1, as indicated by arrow 34, passing first over the periphery of roll 24 and then over the periphery of roll 22. Preferably, the sheet 10 is wrapped about a portion of the periphery of each roll so as to stabilize the sheet 10 against shifting in a cross-machine direction, i.e., in a direction normal to arrow 34.

Folding of sheet 10 is effected by an air film roll, or air bar, 40 that is located between the two support rolls 22 and 24 and acts against the top of the sheet 10 in the region of the sheet extending between the support rolls. As viewed in FIG. 2, the air film roll 40 exerts on this region of the sheet a downwardly-directed force that causes the body portion 12 of the sheet (but not the edge 16) to be deflected toward a zone 42 located between the axes 26 and 30 of the support rolls 22 and 24. As a result, the body portion 12 of the sheet follows the downwardly depressed pass line 35 (FIG. 2) in passing between the peripheries of the two support rolls 24 and 22; and the edge 16 follows the horizontal pass line 36 in extending between these peripheries. (As shown in FIG. 2, horizontal pass line 36 is tangent to the peripheries of the two support rolls 22 and 24.)

Figure 5:
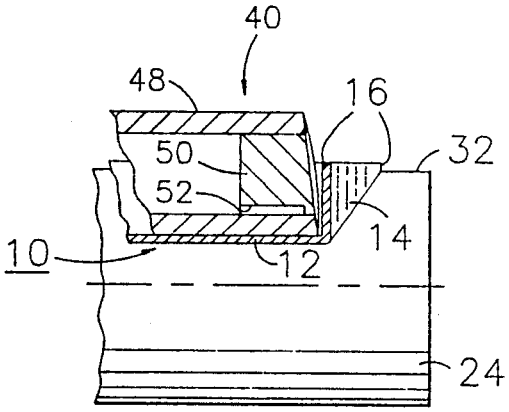
FIG. 5 is a sectional view along the line 5—5 of FIG. 1.

As viewed in FIGS. 1 and 5, the air film roll 40 has an outer end 44 that is positioned at the crease line 20. This outer end 44 is of a substantially planar configuration and, as viewed in the plan view of FIG. 1, is oriented at an angle relative to the crease line 20 that allows the edge 16 and edge portion 14 of the sheet to pass the outer end of the air film roller via a straight line path. In one embodiment of the invention, this angle, shown at 46 in FIG. 1, is about 8 ½ degrees. This angle is selected based upon the distance between the rolls 22 and 24 and the width of the edge portion 14 to be folded over.

Figure 2:
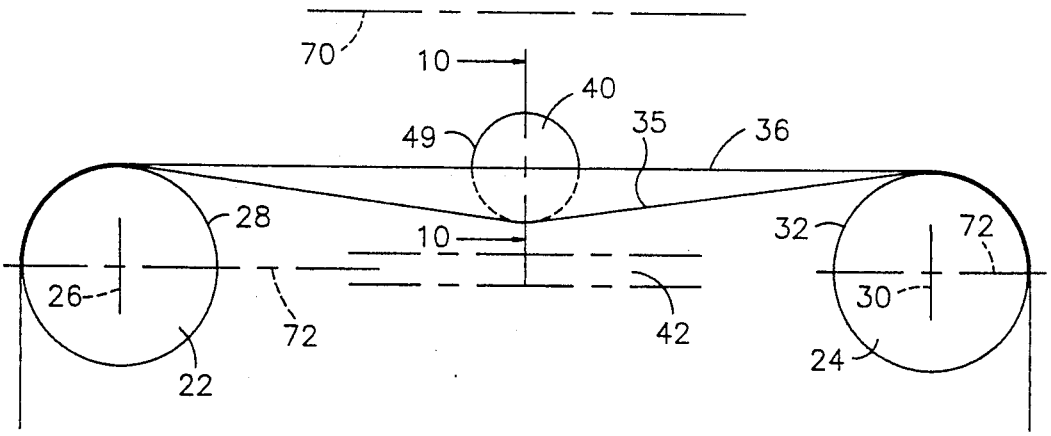
FIG. 2 is a side elevational view of the apparatus of FIG. 1 as the apparatus performs the folding operation.

The plan view of FIG. 1 may be thought of as a view taken from a viewing plane 70 shown in FIG. 2. This viewing plane is substantially parallel to a reference plane 72 containing the axes 26 and 30 of the two support rolls and is located at the outer side of the air film roll 40.

Figure 4:
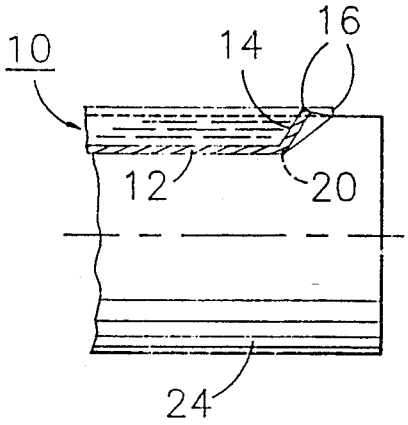
FIG. 4 is a sectional view along the line 4—4 of FIG. 1.
Figure 6:
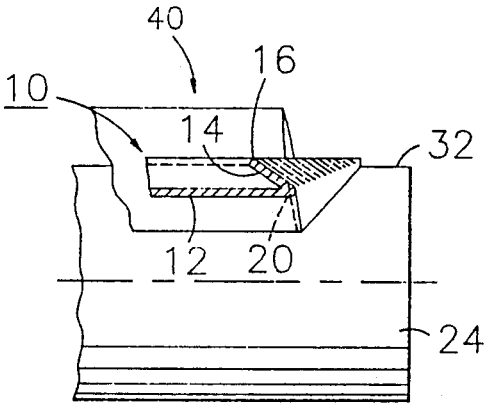
FIG. 6 is a sectional view along the line 6—6 of FIG. 1.

Before describing the details of the air film roll 40, the configuration of the fold will be described with reference to the cross-sectional views of FIGS. 3-7. FIG. 3 shows the sheet 10 in its unfolded condition just before the folding operation begins. In FIG. 3, the edge portion 14 is shown in an in-line position with respect to the body portion 12. FIG. 4 shows the sheet in cross-section at location 4—4 of FIG. 1. At this location the edge portion 14 is disposed at an angle of about 135 degrees with respect to the body portion 12 after having been folded into this position along crease line 20. FIG. 5 shows the edge portion 14 at location 5—5, which is a cross-sectional location on the center line of the air film roll 40. Here the edge portion 14 has been folded up along crease line 20 to about 90 degrees with respect to the body portion 12 of the sheet. FIG. 6 shows the edge portion 14 at location 6—6 of FIG. 1. Here the edge portion has been folded to an angle of about 45 degrees with respect to the body portion 12. FIG. 7 shows the edge portion at location 7—7 of FIG. 1, folded into its fully-folded position where it is doubled back onto the body portion, disposed, in effect, at zero degrees with respect to the body portion.

Before the sheet 10 is caused to travel in the direction of arrow 34, the edge portion 14 is folded by hand so that it transitions from its in-line position of FIG. 3 through its positions of FIGS. 4, 5, and 6, successively, into its fully-folded-over position of FIG. 7. Then when the sheet is driven in the direction of arrow 34, the folding operation, started by hand, is continued by the action of the air film roll 40, soon to be described in more detail.

The air film roll, or air bar, 40 is in many respects of a conventional design, and, as such, it comprises a tubular member 48 (FIGS. 5 and 10) that is made of porous metal that allows pressurized air from inside the roll to flow through pores present in the tubular member to the surrounding air space. The air exiting the air film roll develops an air film between the outer periphery 49 of the tubular member 48 and the adjacent portion of the sheet 10 that is partially wrapped around the bottom region of the periphery 49. This air film, or cushion, separates the outer periphery 49 and the sheet 10, normally precluding contact between the periphery and the sheet. The tubular member 48 is made of metal particles sintered together under heat and pressure, but to such an extent that, except where the roll is masked, there are sufficient pores between the particles to allow generally even air flow through the pores in a generally radial direction. In a preferred form of the invention, a portion of the outer periphery 49 of the tubular member is painted, as shown at 51 in FIG. 11 to provide where painted a flow-blocking mask. This mask is present in all regions except in the region within the active surface angle of the roll. The active surface angle is the wrap angle plus about 10 degrees on both contact tangents of the wrap angle. The wrap angle is the angle extending from the point of the sheet-to-roll entrance tangent to the point of the sheet-to-roll exit tangent. By masking the roll as above described, pressurized air is blocked from exiting through inactive areas of the roll, thus conserving air.

Figure 10:
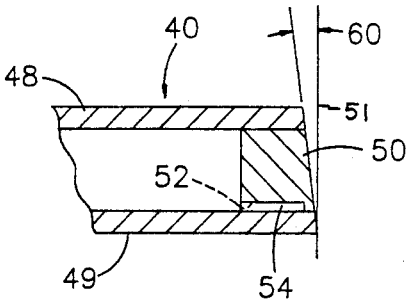
FIG. 10 is a sectional view of the air film roll more generally depicted in FIG. 5.
Figure 11:
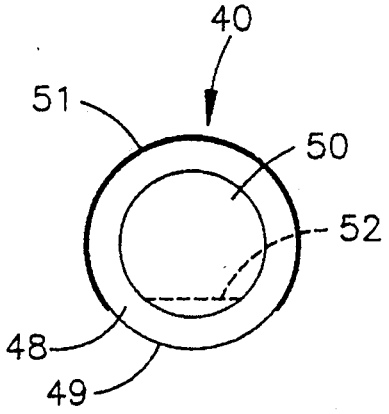
FIG. 11 is an enlarged end view of the air film roll shown in FIG. 10.

Referring to FIGS. 5 and 10, the outer end of the air film roll 40 is closed off by a plug 50 of non-porous material that prevents air from escaping through this outer end. The plug has a flattened portion 52 located at its bottom and extending axially of the air film roll to a point as close as feasible to the extreme outer end of the roll. The space 54 between this flattened portion 52 and the adjacent cylindrical inner periphery of the tubular member 48 provides a wide passageway through which pressurized air from within the tubular member can exit through the bottom of the porous tubular member via a zone extending as close as possible to the outer end of the air film roll.

Preferably, the plug 50 is pressed into the bore of the tubular member 48, and then the outer end 44 of the air film roll is machined to the required angle. In addition to the angle 46 depicted in the plan view of FIG. 1, the outer end of the roll 40 has an angle 60 depicted in FIGS. 5 and 10 which recesses the top portion of the outer end of the air film roll from a vertical plane 51 (also referred to herein as an "adjacent end plane", which plane is perpendicular to the longitudinal axis of the air film roll) so as to prevent the flipped-up edge of the partially-folded edge portion 14 from rubbing on the end of the air film roll as the edge travels past this end during the folding operation. In one embodiment of the invention, angle 60 is about 3 degrees. The other angle 46, shown in FIGS. 1 and 8, can be thought of an angle between the adjacent end plane 51 and the surface of outer end 44 when viewed from the viewing plane 70 of FIGS. 2 and 9. FIG. 10 can be thought of as being taken from a second viewing plane perpendicular to the first viewing plane 70 and extending through the longitudinal axis of the air film roll 40.

It is to be noted that the air film roll 40 does not rotate. As a result, the surface present on its outer end maintains a constant angular relationship with respect to the edge portion 14 traveling past this end surface. This is an advantage of the non-rotating air film roll, contributing to a clean and predictably shaped fold. While it is possible to effect folding over of the edge portion 14 of the foil sheet using an ordinary rotating roller in place of the air film roll 40, this approach is disadvantageous for a number of reasons, one of which is that the desired angles cannot be provided and maintained at the end of the roller because the rotation of the roller would continuously change the geometric relationship of the end surface to the edge portion 14. On the other hand, if the end surface of the roller is perpendicular to the central longitudinal axis of the roller, the flipped-up edge of the edge portion 14 cannot pass by the roller as cleanly as in our illustrated arrangement.

While a non-rotating roll without the air film feature could be used instead of the air film roll shown, this approach is disadvantageous because such a roll would make rubbing contact with the sheet 10, thereby creating drag on the sheet and also generating dirt particles., If such a roll is used, it preferably should be of substantially the same external shape as the illustrated air film roll.

Certain operating principles that are employed by our folding apparatus will now be described by referring to FIG. 8, which is a simplified version of the plan view contained in FIG. 1, and to FIG. 9, which is basically a simplified version of the side elevational view contained in FIG. 2. One of our objectives is to maintain substantially the same path length of the body portion 12 of the sheet 10 and the edge 16 being folded over. Attainment of this objective enables us to maintain tension at the same level in the edge 16 as in the body portion 12 of the sheet so that undue stress is not imposed upon the edge, which could cause breaks in the edge. Another of our objectives is to maintain control of the edge at all times.

Figure 8:
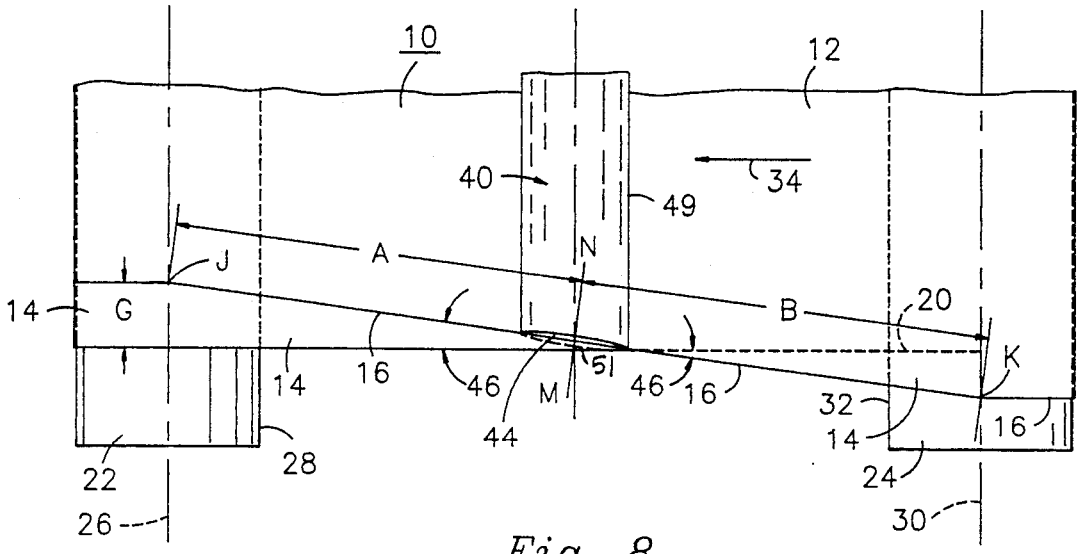
FIG. 8 is a simplified version of the plan view of FIG. 1.
Figure 9:
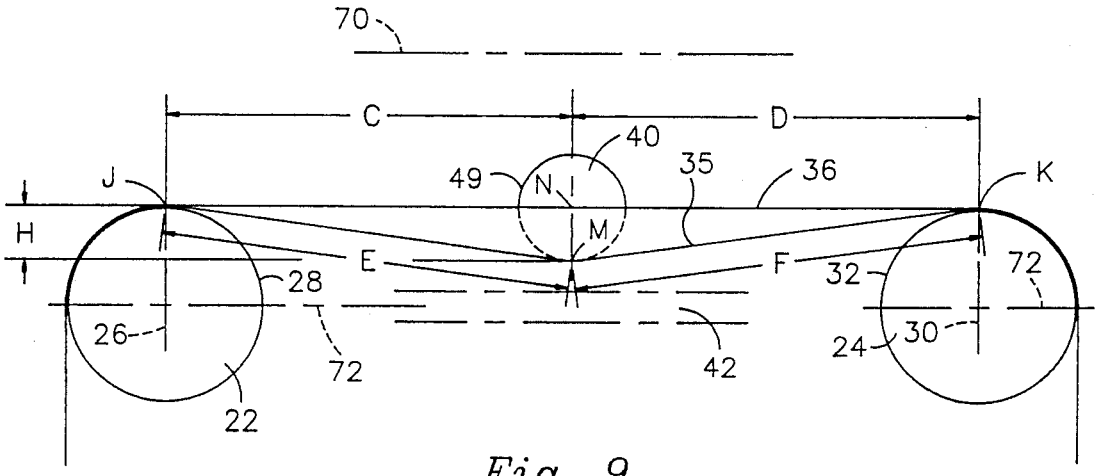
FIG. 9 is a simplified version of the side elevational view of FIG. 2.

Referring to FIGS. 8 and 9, the dimension A is the travel distance of the edge 16 in passing between the air film roll 40 and the support roll 22 (i.e., between points N and J); the dimension E is the travel distance of the body portion 12 in passing between the air film roll 40 and the support roll 22 as measured along the crease line 20; the dimension B is the travel distance of the edge 16 in passing between the support roll 24 and the air film roll 40 (i.e., between points K and N); and the dimension F is the travel distance of the body portion 12 in passing between the support roll 24 and the air film roll 40 as measured along the crease line 20. Referring further to FIGS. 8 and 9, the dimension G (which is the width of the fold in FIG. 8) is made equal to the dimension H (which is the distance between N and M in FIG. 9). Therefore, dimension A (FIG. 8) is equal to dimension E (FIG. 9), and dimension B (FIG. 8) is equal to dimension F (FIG. 9). Thus, the travel distance E + F of the body portion 12 during folding is equal to the travel distance A + B of the edge 16. The spacing C + D (FIG. 9) between the start of the fold and the end of the fold can be of any convenient distance. The crucial dimensions are G and H. The angle 46 ideally varies depending upon the spacing C and D in FIG. 9 and the width of the fold G in FIG. 8. In one embodiment this angle 46 is about 8.5 degrees.

In several practical applications of the invention, the two rolls 22 and 24 are between 1 and 3 inches in diameter, and the air film roll is ½ to 2 inches in diameter. The spacing between the rolls 22 and 24 is between 5 and 10 inches, with the air film roll approximately centered between rolls 22 and 24. The fold is ⅛ to ⅜ inches in width G. In a preferred form of the invention, the dimension D is slightly less than the dimension C. Also the distance H is slightly greater than G, which brings the tension in the edge 16 slightly below that on the body of the sheet 10.

In tests of this device, the foil sheet 10 has been run at several hundred feet per minute, which is a relatively high speed considering the high quality of the fold. The air flow through the air film roll was 0.02 SCFM per square inch of active area.

Another advantage of this folding apparatus is that it is capable of folding the edge portion in a very short distance (C + D of FIG. 2), which is advantageous in that it limits the sheet span between rollers 22 and 24 to a low value, thus reducing the chances for damage to the sheet.

Still another advantage of the illustrated folding apparatus is that it can unfold the edge portion 14 of the sheet 10 if the sheet is stopped and caused to run in a reverse direction from that depicted by arrow 34.

While we have shown ordinary rotatable rolls (22 and 24) as being used for supporting and guiding the sheet 10 during the folding operation, it is to be understood that air film rolls may be substituted for these rolls. We prefer, however, to use the rotatable rolls shown because they provide more stability to the sheet in a cross-machine direction (normal to arrow 34). Also use of a rotatable roll on the outgoing side is advantageous because it acts to more positively set the fold than would an air film roll in this position.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim is:

1. Apparatus for folding over along a crease line an edge portion of a thin sheet of material, which sheet comprises on opposite sides of said crease line a body portion and an edge portion integral with the body portion and extending between the body portion and an edge of the sheet, the edge portion being substantially in line with the body portion when the sheet is unfolded and being doubled back into an overlapping position with respect to said body portion when the sheet is fully folded, said apparatus comprising:

(a) a pair of support rolls having laterally spaced-apart axes and peripheries over which said sheet is caused to pass so that a predetermined region of said sheet extends between said peripheries as the sheet travels from a first one of said support rolls to a second one of said support rolls, (b) an air film roll having a longitudinal axis and positioned between said support rolls and exerting on said predetermined region of said sheet a force that causes the body portion of the sheet in said predetermined region to be deflected toward a reference plane in which said support roll axes are located, and in which:

(c) said air film roll has an outer end that is located at said crease line so that said edge portion folds along said crease line from said in-line position at said first support roll to a position substantially perpendicular to said body portion at said outer end of the air film roll and folds along said crease line from said perpendicular position to said overlapping position in the zone of said sheet extending between said outer end of the air film roll and said second support roll, said edge and said edge portion when said edge portion is in said substantially perpendicular position are disposed in close proximity to said outer end of the air film roll, (d) said outer end of said air film roll has a substantially planar configuration and angles in two directions with respect to an adjacent end plane perpendicular to the longitudinal axis of the air film roll, (e) there is a first viewing plane parallel to said reference plane on the outer side of said air film roll, (f) when said air film roll and said predetermined region of said sheet are viewed from said first viewing plane, said outer end of the air film roll angles in a first of said two directions with respect to said perpendicular end plane that allows said edge of the sheet to pass said outer end via a straight line path extending between said support rolls, and (g) when viewed from a second viewing plane perpendicular to said first viewing plane and extending through the longitudinal axis of said air film roll, said outer end of the air film roll angles in a second of said two directions with respect to said perpendicular end plane to recess away from the perpendicular end plane the portion of said outer end nearest said first viewing plane.

2. The apparatus of claim 1 in which said air film roll includes:

(a) a porous wall portion in the active surface angle region of the air film roll where said sheet moves past said air film roll in close proximity to the outer periphery of said air film roll, (b) a bore containing pressurized air that flows through the pores in said porous portion generally radially outward to provide an air film between the outer periphery of a said air film roll and said sheet, (c) a substantially non-porous plug in said bore for blocking air from exiting the bore through the outer end of said air film roll, and (d) masking means for blocking the flow of pressurized air from said bore through regions of said air film roll outside of said active surface angle region.

3. The apparatus of claim 2 in which there is provided between said plug and the bore of said air film roll a channel that extends longitudinally of said air film roll to a point closely adjacent said outer end of the air film roll, the channel serving to make the porous wall portion in said active surface angle region accessible to said pressurized air in regions closely adjacent said outer end of the air film roll.

4. The apparatus of claim 1 in which:

(a) said edge portion has a width G as measured from said crease line to the edge of the sheet, (b) said air film roll causes the body portion of said sheet to be deflected toward the zone between said support roll axes by an amount H as measured at the air film roll from a line tangent to the peripheries of said two support rolls, (c) G is substantially equal to H, and (d) G and H have values not greater than the diameter of said air film roll.

* * * * *